United States Patent [19]

Dawson

[11] 3,959,917

[45] June 1, 1976

[54] FLYING TOY

[75] Inventor: Stanford Dawson, Brooklyn, N.Y.

[73] Assignee: Lawrence Peska Associates, Inc., New York, N.Y. ; a part interest

[22] Filed: Aug. 20, 1975

[21] Appl. No.: 606,219

[52] U.S. Cl. ..... 46/74 D; 46/87

[51] Int. Cl.[2] ..... A63H 27/00

[58] Field of Search ..... 46/74 D, 87, 88

[56] References Cited

UNITED STATES PATENTS

| | | | |
|---|---|---|---|
| 3,742,643 | 7/1973 | Keith | 46/74 D |
| 3,758,985 | 9/1973 | Heisler | 46/74 D |

*Primary Examiner*—Louis G. Mancene
*Assistant Examiner*—Robert F. Cutting
*Attorney, Agent, or Firm*—Jack D. Slobod

[57] ABSTRACT

A disc-shaped flying top is formed by an air inflatable elastic envelope having a central cylindrical hub surrounded coaxially by a toroidal rim. Webs radiating between the hub and the rim are inclined in rotor blade fashion to provide a thrust when the toy is rotated about its axis. An air jet directed along the axis of the toy provides lift as the interior pressurized air is exhausted and as well provides an inlet for initially inflating the toy.

3 Claims, 4 Drawing Figures

FLYING TOY

FIELD OF THE INVENTION

The invention relates generally to saucer or disc shaped flying toys. In its particular aspects the present invention relates to a generally circular air inflatable spinning envelope which has a jet opening for the pressurized air within the envelope to be exhausted for thrust purposes.

BACKGROUND OF THE INVENTION

Various saucer-shaped flying or soaring toys have heretofore been proposed which are thrown by hand with a spin imparting motion. These known devices have not flown for as long a distance as may be desired because their range was limited by the energy imparted in the throwing motion.

OBJECTS OF THE INVENTION

It is an object of the present invention to provide a saucer-shaped flying toy having an increased range.

It is another object of the present invention to provide a flying toy of the type adapted to be thrown, which has stored air exhausted for lift generation purposes.

SUMMARY OF THE INVENTION

Briefly, the aforementioned and other objects of the present invention are satisfied by providing a flying toy which is formed by a generally circular elastic envelope. The envelope includes an inflatable hub portion surrounded coaxially by an inflatable rim portion. Webs or channels running between the hub and rim are shaped and inclined to form rotor blade members.

Lift is provided in two ways. The toy is thrown with a spin imparting motion in which the rotor blade members convert rotation to a lifting force. Further, an air exhaust port depending from the hub portion is provided so that pressurized air stored within the envelope is exhausted to provide additional lift to enable flights of a long duration.

Other objects, features and advantages of the present invention will become apparent upon perusal of the following detailed description of the preferred embodiment thereof when taken in conjunction with the appended drawing wherein.

DETAILED DESCRIPTION

Figure 1:
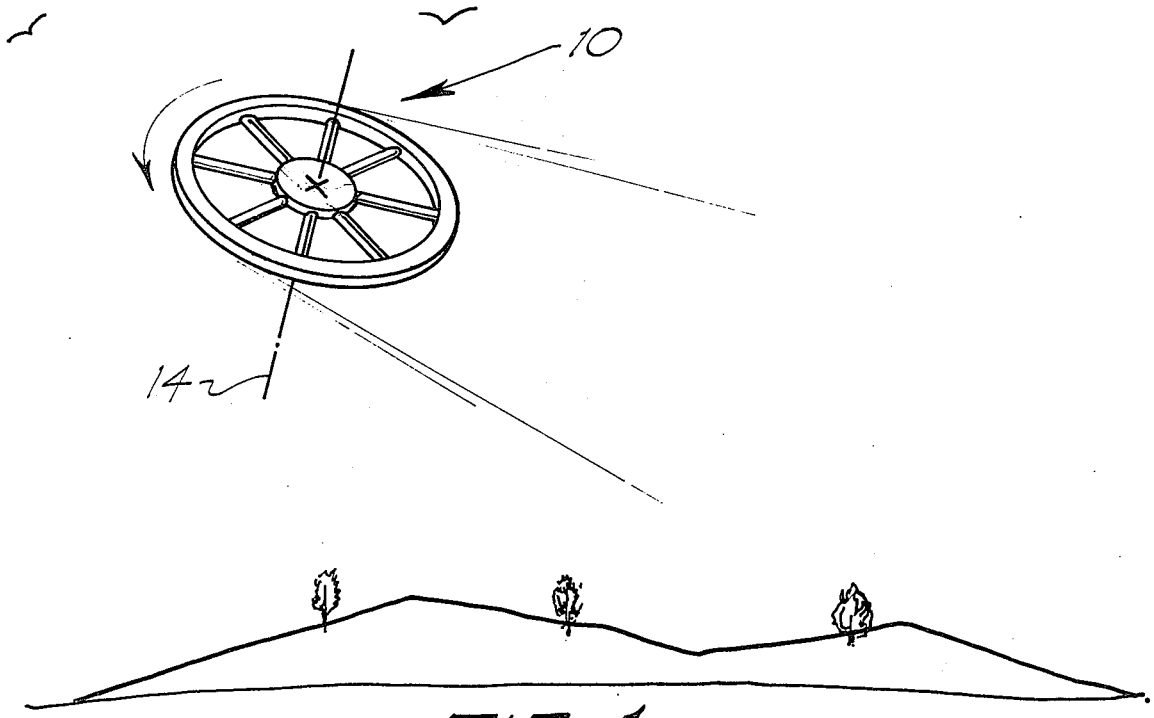
FIG. 1 is a pictorial presentation of the toy of the present invention in flight.
Figure 2:
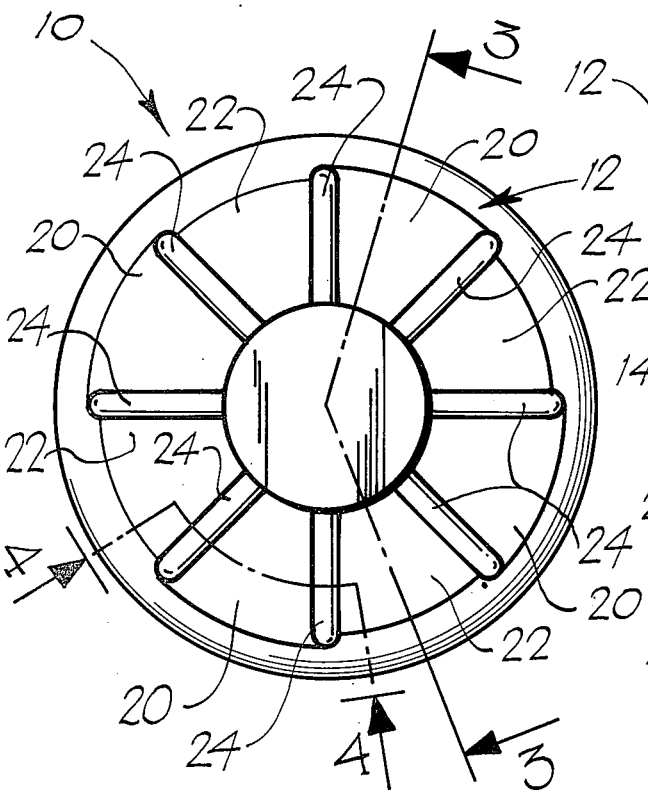
FIG. 2 is a top view of the toy in FIG. 1.
Figure 3:
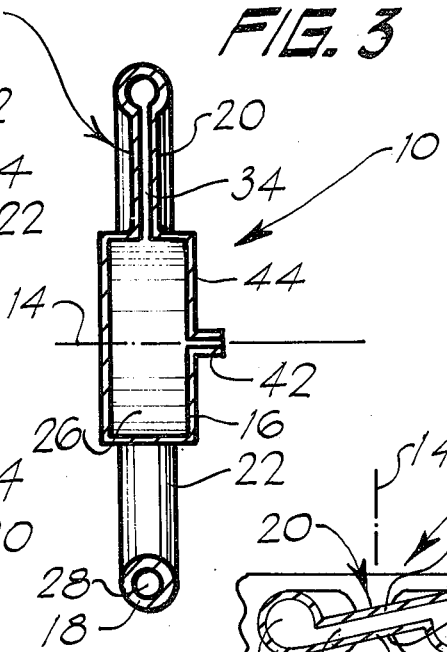
FIG. 3 is a staggered cross-sectional view taken along the lines 3—3 in FIG. 2.
Figure 4:
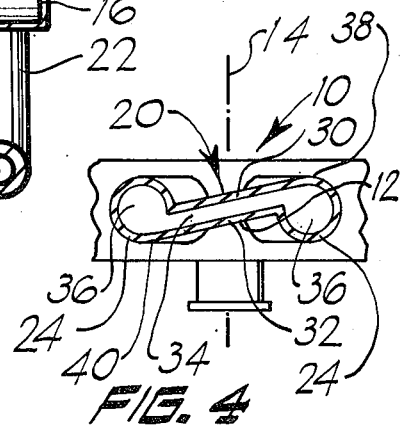
FIG. 4 is a cross-sectional view taken along the lines 4—4 in FIG. 2.

Referring to FIGS. 1 through 4 of the drawing, the flying toy of the present invention is generally indicated by the reference numeral 10. Toy 10 is a circular, generally disc-shaped body formed by an air inflatable envelope 12 of elastic material such as rubber or plastic of substantially constant thickness. The toy 10 has a central geometric axis of symmetry 14 about which the toy rotates when thrown with a spin imparting motion with axis 14 primarily vertically oriented.

The envelope 12 includes a central cylindrical hollow hub 16; a toroidal hollow rim 18 coaxially surrounding hub 16 and a plurality of web sectors 20 radiating between hub 16 and rim 18. Web sectors 20 are angularly spaced apart and sector shaped openings 22 are defined therebetween.

The web members 20 are stiffened by generally tubular spoke portions 24 radiating between the hub 16 and rim 18 in angularly spaced relation. Spoke portions 24 provide fluid communication between the hollow interior 26 of hub 16 and the hollow interior 28 of rim 18. Web members 20 are formed by a pair of spaced parallel planar sectorial walls 30 and 32 spanning angularly between each pair of spokes 24. The walls 30 and 32 intersect the spokes 24 in a manner for an air space 34 between the walls to be in fluid communication with the interiors 36 of the spokes.

The walls 30 and 32 are inclined and have forward radial edges tangentially intersecting the top of one spoke 24 at 38 and rearward radial edges tangentially intersecting the bottom of another spoke 24 at 40.

It should be appreciated that with all web members 20 similarly inclined, the members 20 act as rotor blades for generating a vertical lift force when the toy 10 spins about axis 14.

It should be further understood that all the air spaces previously mentioned, namely 26, 28, 34 and 36, are all in intercommunication and define a chamber surrounded by the elastic envelope 12, which may be charged with air pressure.

The toy 10 is inflated with pressurized air through an inlet tube 42 projecting perpendicularly from the center of the bottom planar wall 44 of hub portion 16. The tube 42, being oriented along axis 14 provides an exhaust means for a jet of air to generate a lifting force. Preferably the tube 42 is dimensioned for the air stored within the toy 10 to be discharged over a period of time on the order of one half minute.

In the use of toy 10, it is first inflated via tube 42 in the same manner as a balloon might be inflated. The toy is then gripped about rim 28 and thrown quickly with a spin-imparting motion before any appreciable amount of the air stored within the toy is discharged from tube 42. The tube 42 is of course pointed downward to generate a lifting force during the flight of the toy. Further, the web members 20 convert the spin of the toy about axis 14 to a lifting force.

By augmenting the lifting force generated in throwing the device with lifting force due to stored air forced out by the elasticity of the envelope, toy 10 can remain in flight on the order of a half a minute, thereby covering large distances.

While the preferred embodiment of the present invention has been described in specific detail, it sould be noted that numerous modifications, additions and omissions in the details thereof are possible within the intended spirit and scope of the invention claimed herein.

What is claimed is:

1. A flying toy comprising a generally circular air inflatable envelope for storing pressurized air, said envelope having a central geometric axis about which said envelope is adapted to spin, and jet means communicating from the interior to the exterior of said envelope for applying a lifting force to said envelope upon exhaust of air from the interior of said envelope therethrough.

2. The flying toy of claim 1 wherein said envelope comprises an inflatable hub portion, an inflatable rim portion coaxially surrounding said hub portion and a plurality of webs radiating between said hub portion and said rim portion, said webs including air channels for fluid communication between said hub portion and said rim portion, said webs being inclined for lifting said envelope upon rotation of said envelope about said axis.

3. The toy of claim 2 wherein said jet means is carried by said hub portion, and is directed in one direction along said axis, and wherein said jet means comprises means for inflating said envelope.

* * * * *